US005136762A

United States Patent [19]

Gironi

[11] Patent Number: 5,136,762

[45] Date of Patent: Aug. 11, 1992

[54] METHOD OF AUTOMATIC DRAWING-IN AND MACHINE FOR CARRYING OUT THE SAID METHOD

[76] Inventor: Fabrizio Gironi, Via del Palco 24, Prato (Firenze), Italy

[21] Appl. No.: 588,663

[22] Filed: Sep. 26, 1990

[30] Foreign Application Priority Data

Sep. 28, 1989 [IT] Italy ..... 9534 A/89

[51] Int. Cl.[5] ..... D03J 1/14

[52] U.S. Cl. ..... 28/204; 28/205; 28/201

[58] Field of Search ..... 28/191, 192, 201, 203, 28/204, 205-207

[56] References Cited

U.S. PATENT DOCUMENTS 2,828,527 4/1958 Meierhofer ..... 28/206
3,121,936 2/1964 Meierhofer ..... 28/206
4,891,871 1/1990 Tachibana et al. ..... 28/206 X

FOREIGN PATENT DOCUMENTS 1352332 5/1974 United Kingdom ..... 28/204

*Primary Examiner*—Werner H. Schroeder
*Assistant Examiner*—John J. Calvert
*Attorney, Agent, or Firm*—McGlew & Tuttle

[57] ABSTRACT

A method and apparatus for carrying out an automatic drawing-in is provided including forming lengths of thread which are double folded. The thread is passed to a corresponding heddle and between corresponding dents of a reed. The threads are leased and placed under tension. Progressively, the various threads which are leased and under tension are moved away from the drawing-in location. Heddles are selected from a plurality of magazines and the heddles are positioned in a drawing-in attitude. The reed is positioned and the dents are spread for passage of the various threads. The warp threads are passed by moving the drawn-in heddles directly from the associated magazines to a heddle frame of a corresponding set of heddle frames. The heddles are always retained in a guide.

17 Claims, 23 Drawing Sheets

METHOD OF AUTOMATIC DRAWING-IN AND MACHINE FOR CARRYING OUT THE SAID METHOD

FIELD OF THE INVENTION

The present invention relates generally to production of woven structures and more particularly to a method for automatic drawing-in and a machine for carrying out the method.

BACKGROUND OF THE INVENTION

It is known that drawing-in comprises passing threads, obtained from the warp beam, through the wires of the warp stop, through the heddles of the heddle frames and through the dents of the reed. Given that the complete operation takes a considerable time, it is generally performed away from the loom, after which the beam thus prepared is transferred and loaded onto the loom. Automatic drawing-in is currently performed either with three separate machines, one for each of the three operations, in other words a wire setter, a heddle frame threader and a reed threader, or using a single machine for the three operations, simultaneously. The main machines of the second type as known today essentially has a group including the heddle hook, the heddle selector, the reed, the wire setter, the thread gripper, the magazines of the heddles and the wires; and a group comprising the warp beam support, the heddle frames, the warp stop and the leasing.

Drawing-in on such automatic machines entails manual intervention for the following operations.

Before drawing-in:

positioning of the warp beam the thread guards and the heddle frames on the support group;

positioning the leasing, aligning the leased threads with the beam, and fixing the threads thus aligned;

positioning the support thus prepared and latching into the control group;

positioning and selecting the reed. During drawing-in:

visual monitoring and manual displacement of the drawn in threads;

knotting of the threads after breaking. After the drawing-in:

unlatching the support group.

Following this, the beam, the warp stop, the reed and the square heddle frames are transferred by means of 30 carriages into the weaving room, where they are positioned on the loom. The operations require the intervention of specialized personnel, the use of special accessories, at least two support groups to avoid prolonged shutdown of the control group, and hence also a substantial availability of space. All these requirements mean that known automatic machines are very costly both in respect to their construction and in respect to their use. Only major industrial enterprises can employ them because continuous or virtually continuous use is necessary to justify economically profitable running thereof.

SUMMARY AND OBJECTS OF THE INVENTION

The object of the present invention is to propose a method of automatic drawing-in for flat open heddles, and a machine for carrying out the method which is independent in its operation and hence of moderate cost.

This object is achieved, according to the invention, by proposing a method which comprises, in combination forming lengths of thread which are folded double and passing the head and then the tail of each length to corresponding heddles and in corresponding dents of the reed;

leasing the threads of the various lengths thus formed;

progressively moving the various threads thus passed and leased away from the drawing-in head, and tensioning them;

selecting the heddles of a plurality of magazines, positioning them in the drawing-in attitude and, after drawing-in, passing them to the heddle frames of corresponding sets of heddle frames, the heddles always being retained in the guide;

positioning the reed and spreading the dents thereof for the passage of the various threads.

Advantageously, the lengths of thread are obtained from one bobbin or two bobbins of different colors.

The machine for carrying out the method comprises in combination means for supplying to the heddle hook, the head and then the tail of lengths of thread obtained from a bobbin having a thread puller and a thread clamp having a cutter;

means for supporting the length of thread including two superposed horizontal threaded bars rotating in unison in order to support the lengths and move them progressively away from the drawing-in head, and a derailer for deflecting the lengths being formed from the thread puller to the lower threaded bar;

means for leasing the length of thread including an oscillating crank mechanism having a tensor for tensioning the thread during drawing-in;

a magazine for arranging the heddles to be drawn in a pendant position, and comprising a plurality of tracks, each track being associated a corresponding set of a plurality of heddle frames;

means for individually selecting the heddles from the pack of heddles present on each track and having a selector which performs an alternating transverse movement relative to the upper rail of the track, in a manner such as to select the first heddle of the pack which is present and displace it into the drawing-in position;

means for orienting and retaining the heddle thus selected in a position perpendicular to the longitudinal axis of the heddle hook in order to permit the drawing in thereof;

means for supporting the reed in the hozizontal attitude, parallel to the sets of heddle frames having the dents vertical, and positioning it progressively with the dents to be passed in alignment with the longitudinal axis of the heddle hook and with a spreader member in order to permit the passage thereof with the drawing-in of the corresponding heddle;

means for moving each drawn-in heddle from the drawing-in head to one of the heddle frames constituting the corresponding set of heddle frames and, for each track, having a deflector with a plurality of rails having an associated needle, and two pushers acting on the head and on the foot, respectively, of the heddle to be transferred.

The advantages obtained by virtue of the invention reside essentially in the fact that the drawing-in threads are obtained from a bobbin, thus eliminating the use of the warp beam and the associated accessories;

that the yarn used may be preselected as being that most suitable for drawing-in, specifically by reason of its strength, thus eliminating breakages or at least reducing them to the maximum extent;

that it is possible to prepare the loom in advance, that is to say even in the absence of a warp or for the production of samples;

that the preparation operations are simpler and more economical in comparison to those required by the automatic machines known today in that they are limited to the positioning of the frames and of the reed, knotting, and the setting of the wires, that is to say that it may be performed by a skilled though not necessarily specialized individual; and that it is possible to draw in a large number of heddles rapidly and dispose them in accordance with any desired programmed passing of the warp threads.

These and further advantages and features of the invention will be more clearly understood by any person skilled in the art from the description which follows, and with the aid of the attached drawings, which are given by way of a practical illustrative embodiment of a drawing-in machine in accordance with the invention, but are not to be regarded in a limiting sense.

DETAILED DESCRIPTION OF THE PREFERRED EMBODIMENT

Figure 1:
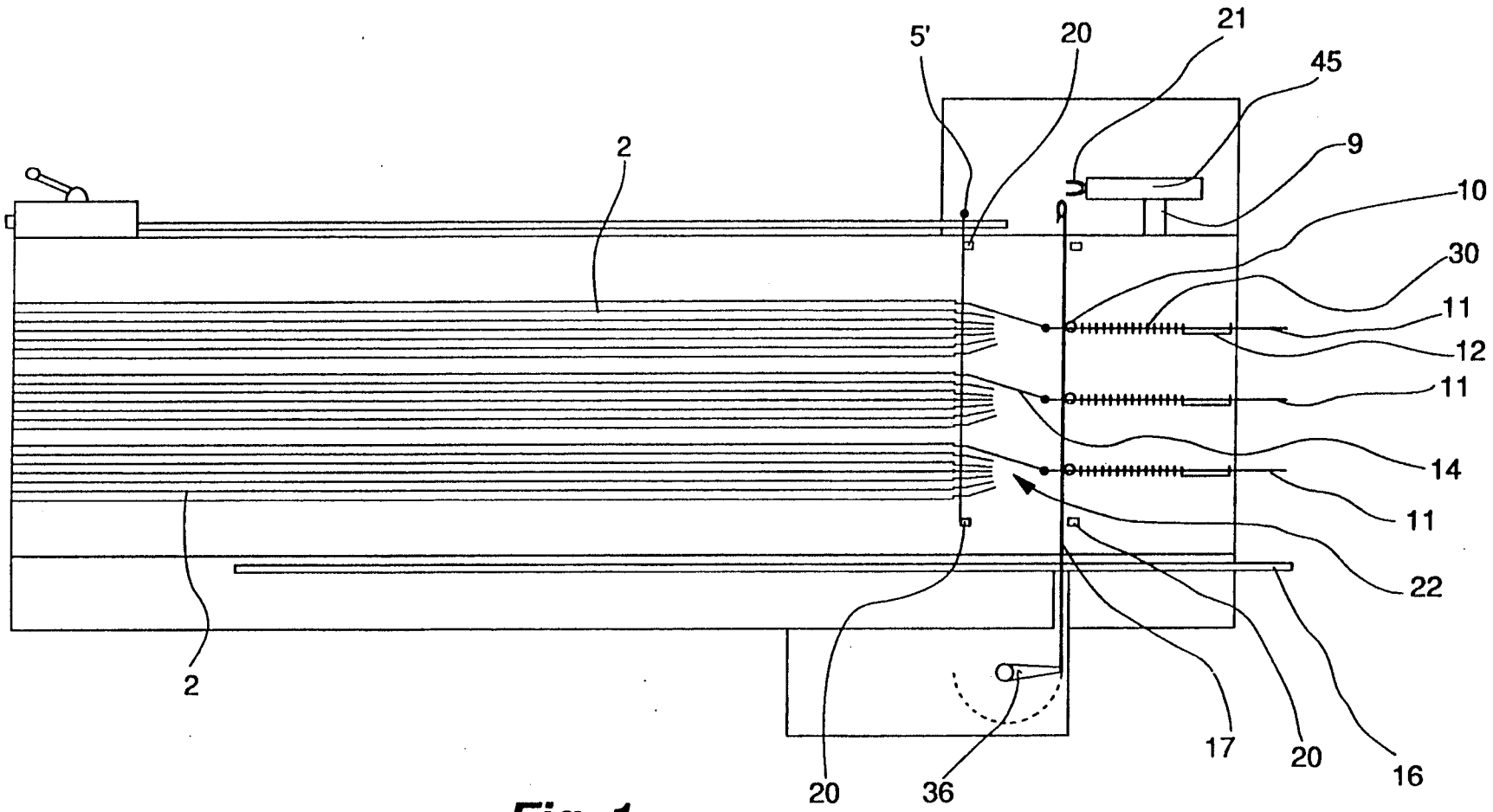
FIG. 1 is a diagrammatic top plan view of an automatic drawer-in according to the invention.

Referring to the drawings in particular, the invention comprises a method and apparatus for drawing-in and leasing. The method comprising the feeding of drawing-in threads 5, the drawing-in of the heddles 30 and reeding, selection of heddles 30 to be drawn-in and the passing of the warp threads. The feeding of the drawing-in threads comprises obtaining lengths of double folded thread 5' from the thread 5 of at least one magazine such as a bobbin 46. The head and then the tail of the thread 5' is passed into corresponding heddles 30 and between corresponding dents of the reed 16. The method then proceeds to leasing and tensioning threads 5' thus formed and reeded and progressively moving the various threads, reeded and leased, away from the drawing-in head.

The reeding comprises the correct automatic positioning of the reed 16 with a first unidirectional forward movement at a constant rate followed by an optional second displacement. This is done in order to obtain a precise alignment between the vertical axis of each space contained between two dents of the reed and the vertical axis of the cross-section heddle hook. A selection of the heddles to be drawn in comprises storing the heddles in a plurality of tracks.

The passing of the warp threads comprises passing the drawing-in heddles directly from a track 11 of an associated magazine to a track 22 of a corresponding set of heddles frames 2. The heddles are always retained in the guide.

FIG. 1 shows an automatic drawing-in apparatus according to the invention wherein a plurality of heddle frames 2 are supported.

Figure 3:
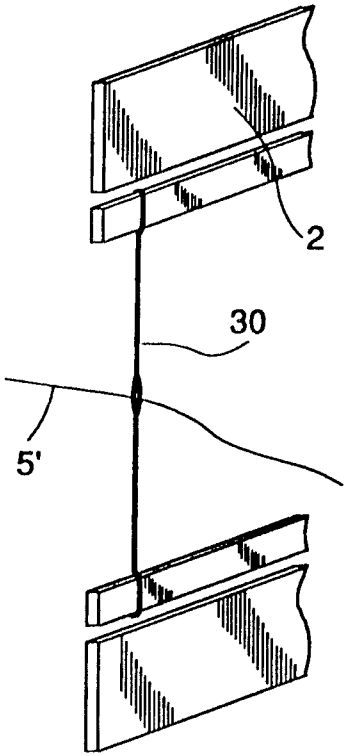
FIG. 3 is a detailed view of a heddle in the associated heddle frame with the thread passed through the eyelet according to the invention.
Figure 2:
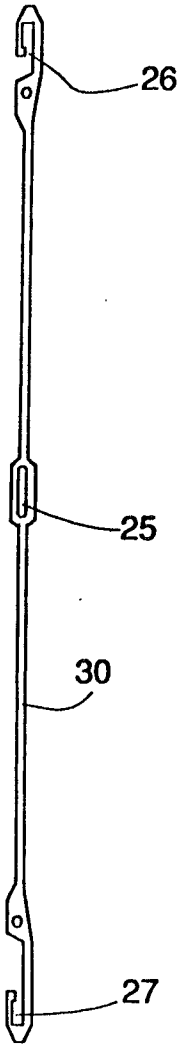
FIG. 2 is a detailed view of a heddle for the drawer-in of FIG. 1.
Figure 4:
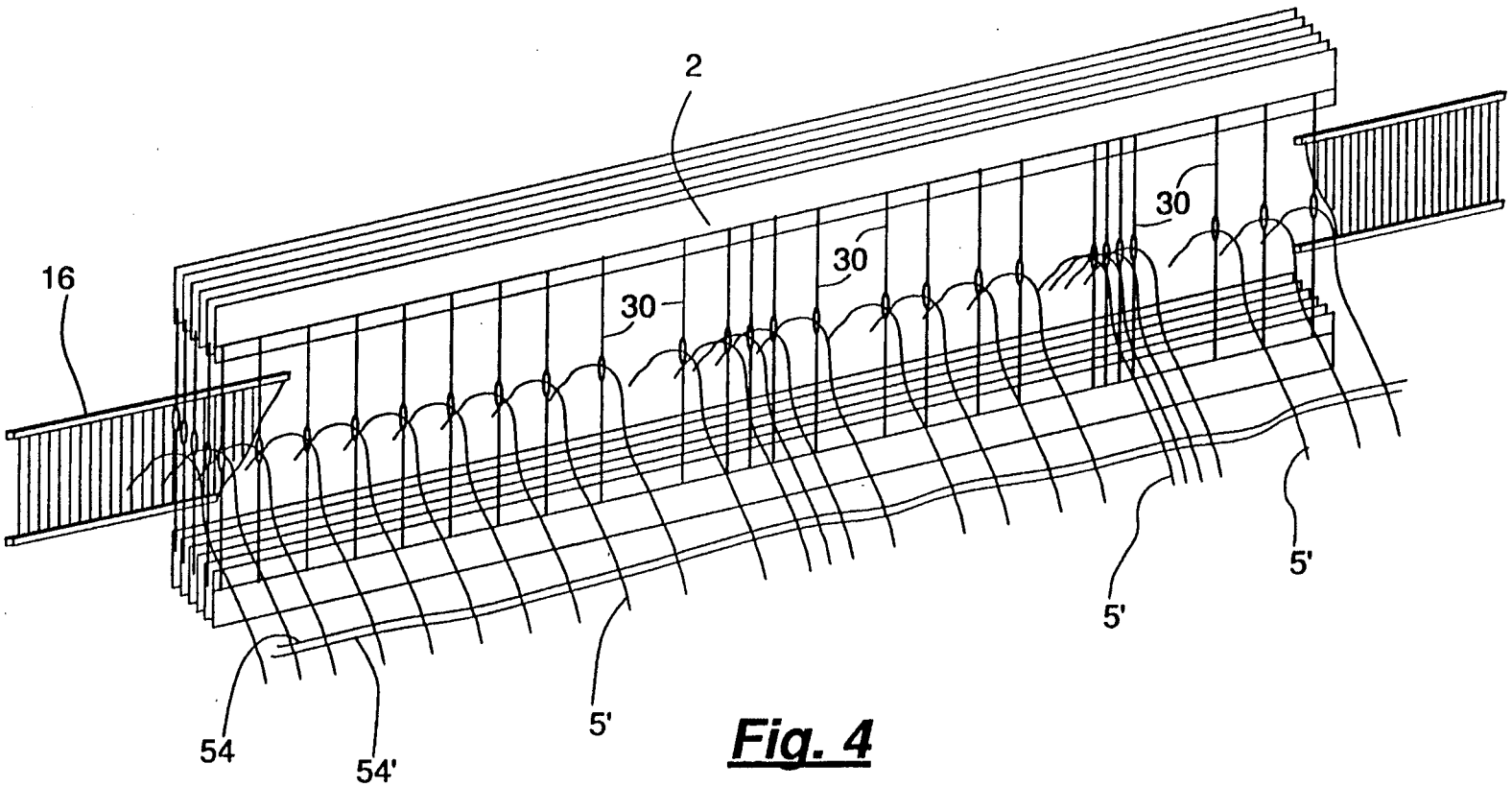
FIG. 4 is a diagrammatic perspective view of the pack of heddle frames and of the reed for drawing-in, passing and eventual leasing according to the invention.

FIG. 3 shows a cut-away perspective view of a heddle frame 2 supporting a heddle 30. As seen in FIG. 2, each heddle 30 include an eye 25 for receiving a thread 5 and an upper loop 26 and a lower loop 27. A horizontal track 11 is provided passing through the respective upper and lower loops 26, 27 of the heddles 30.

Figure 18:
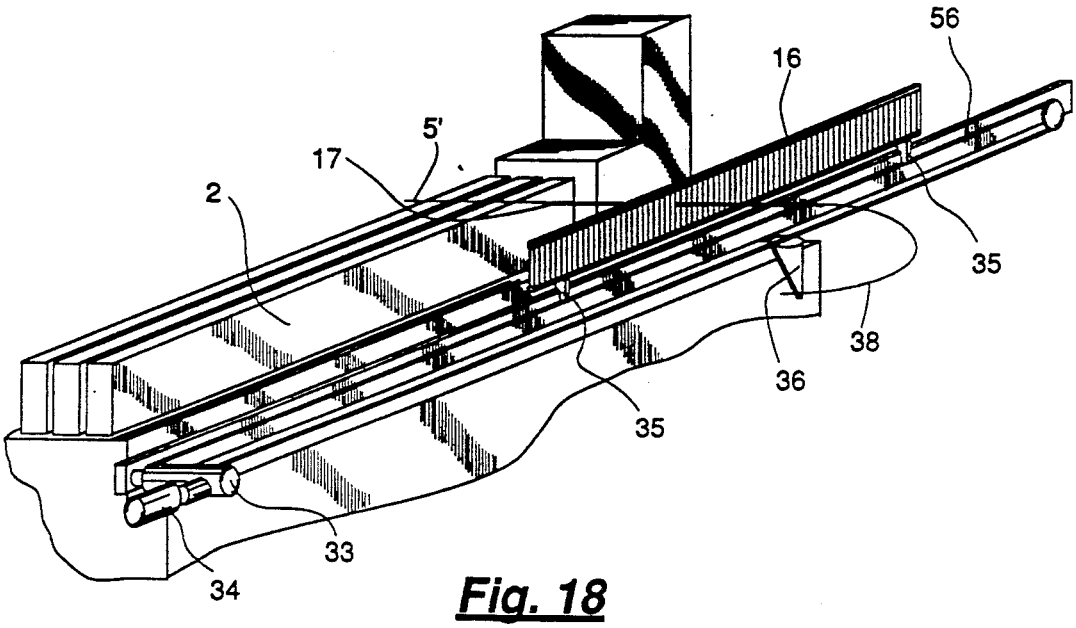
FIG. 18 is a schematic perspective view showing the reed positioning group according to the invention.
Figure 19A:
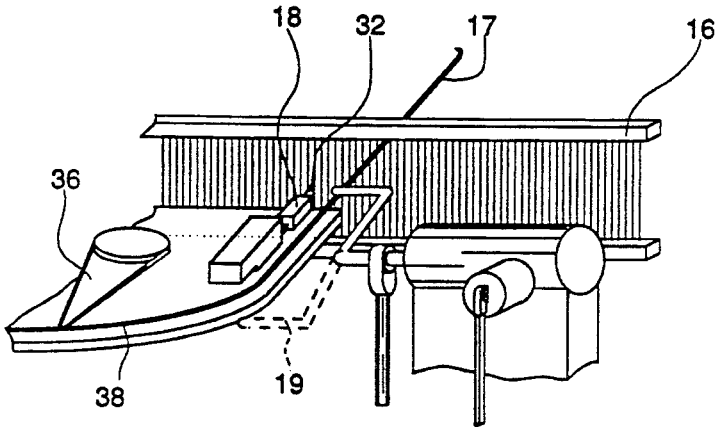
FIG. 19A is a schematic perspective view showing the detail of the reeding group according to the invention.
Figure 19B:
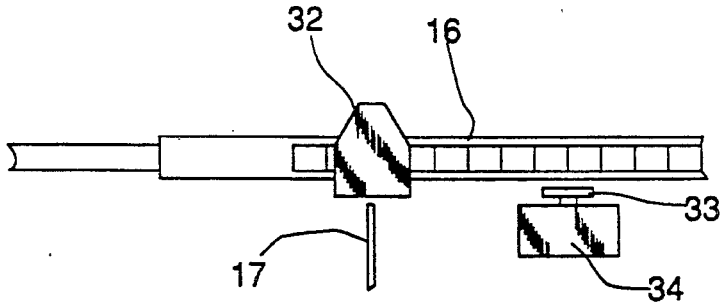
FIG. 19B–E are schematic views showing, diagrammatically, the sequence of operations for reeding according to the invention.
Figure 19C:
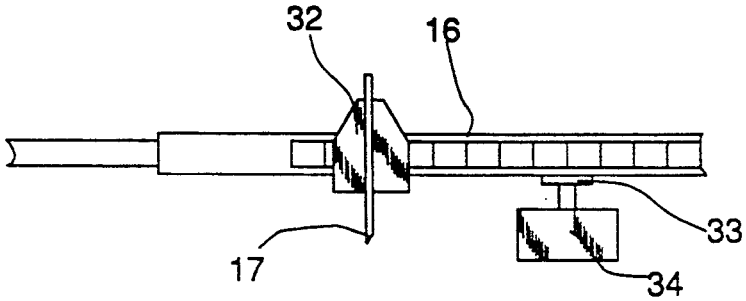
Figure 19D:
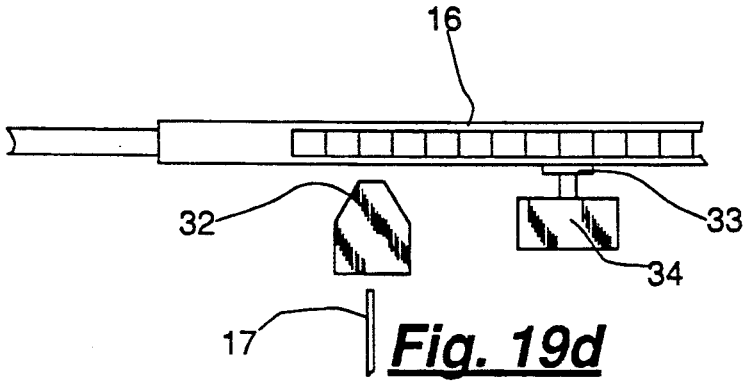
Figure 19E:
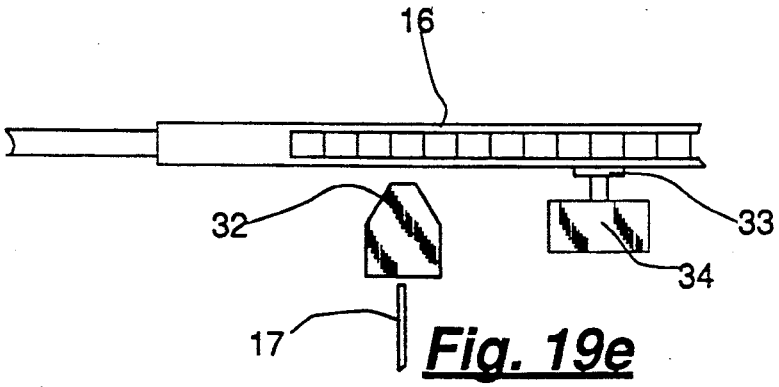
Figure 21:
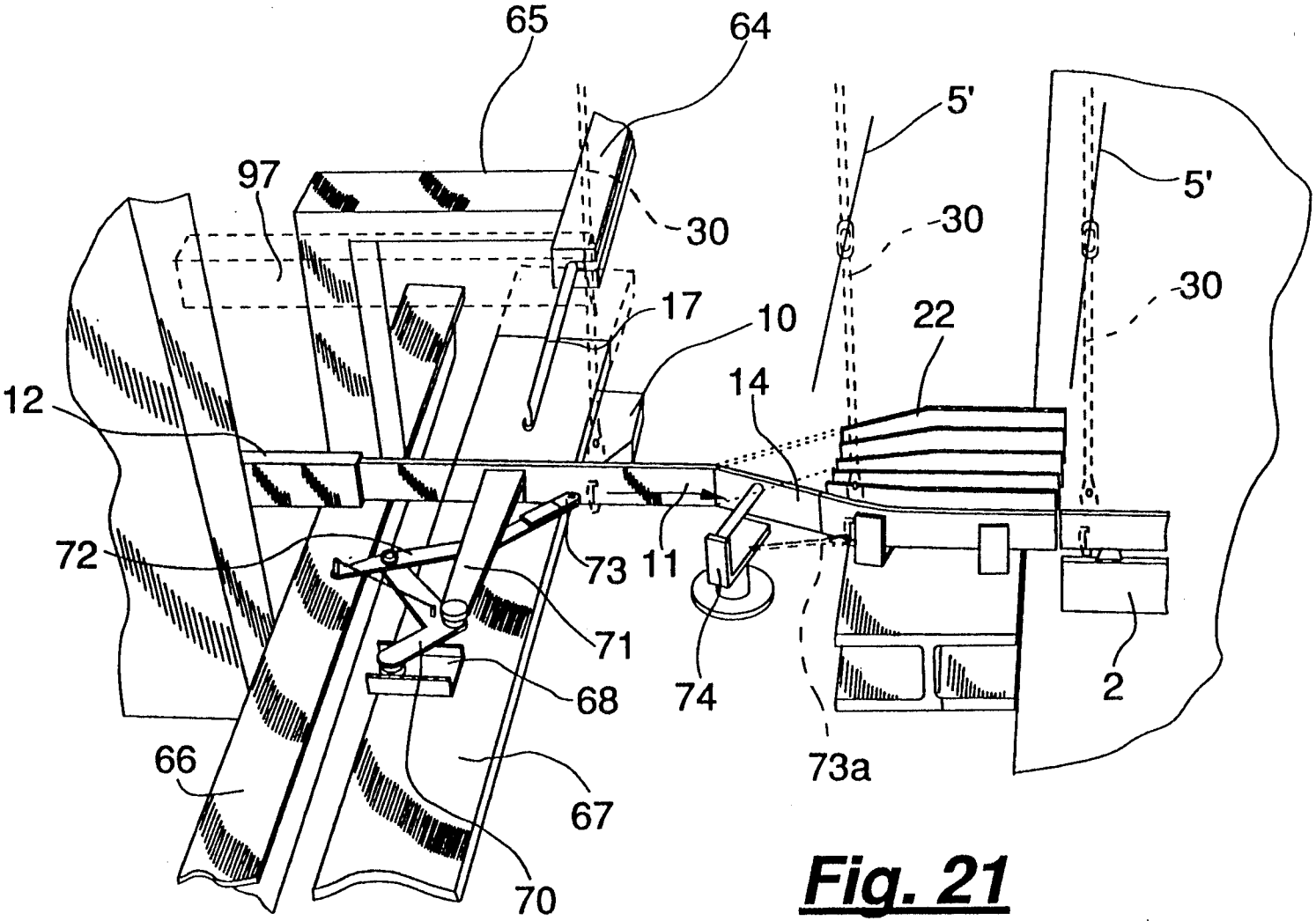
FIG. 21 is a schematic perspective view showing the detail of a deflector for passing the warp thread according to the invention.
Figure 22:
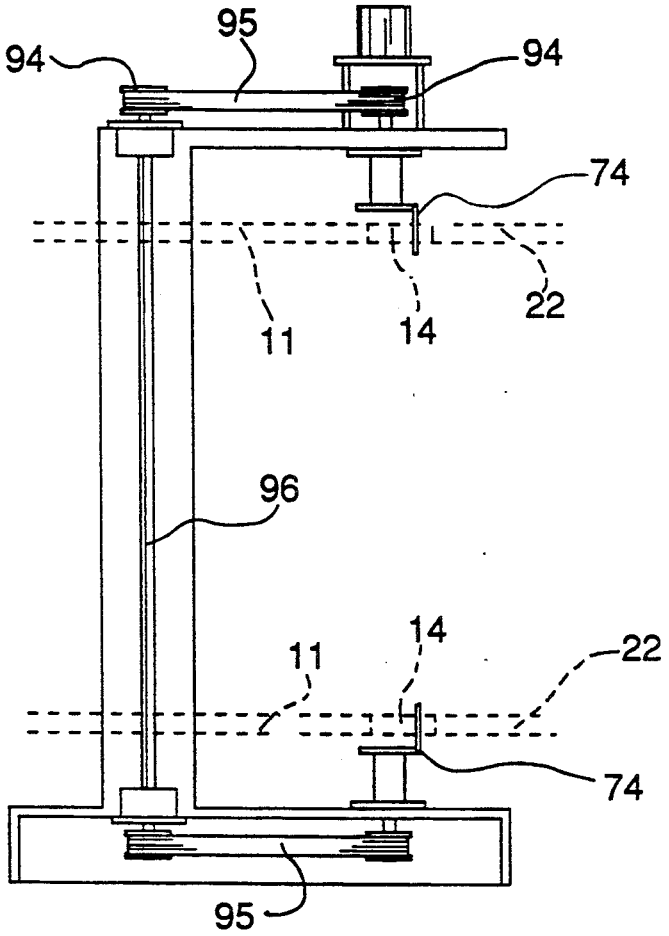
FIG. 22 is a front schematic view of the detail of the needle control for the deflector of FIG. 21.
Figure 23:
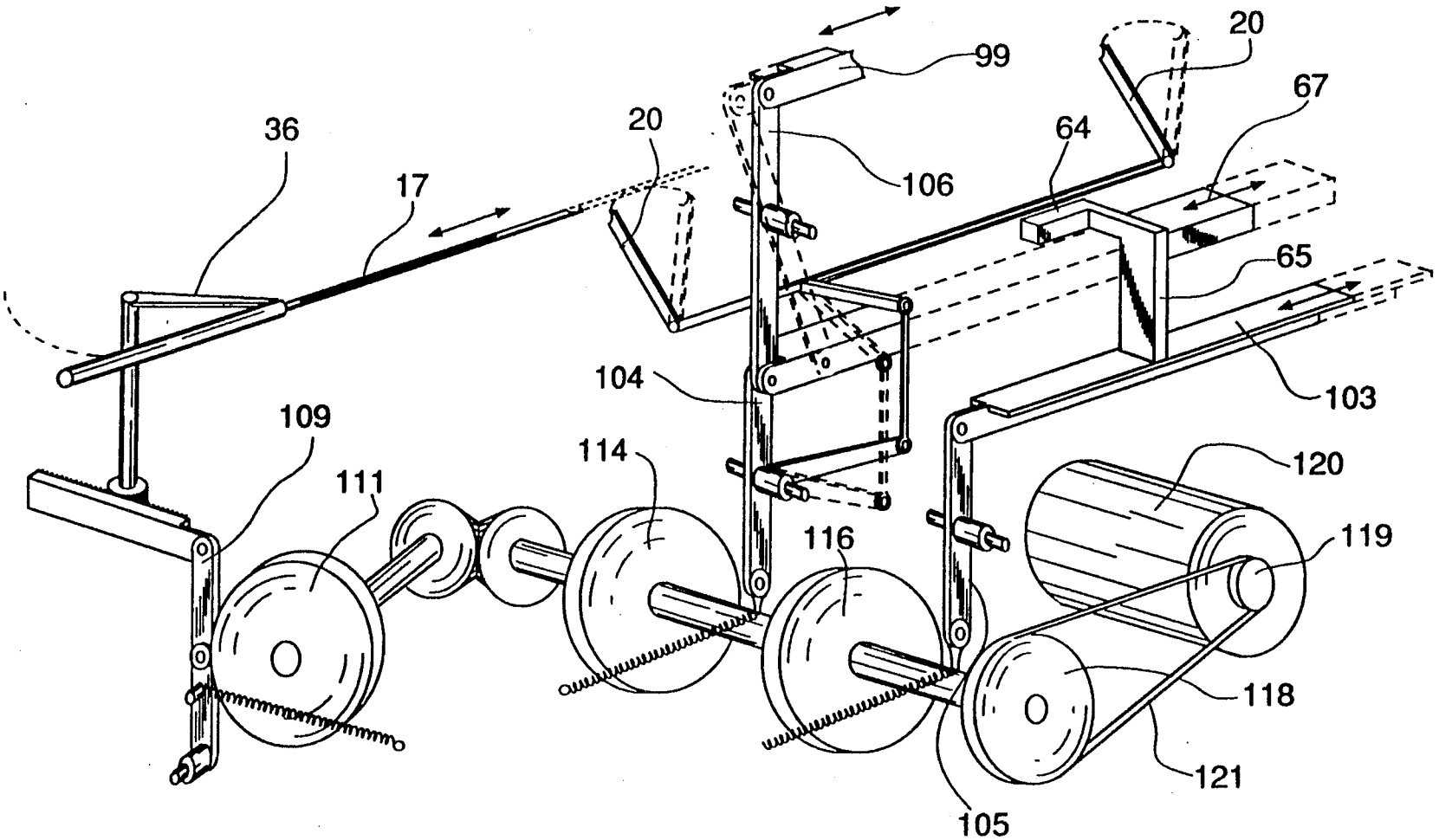
FIG. 23 is a schematic perspective view showing an overall view of the actuating means according to the invention.

The apparatus of the invention as shown in FIG. 1 through 25 includes:

an arrangement for feeding the threads to be drawn in (FIGS. 5–7B);

an arrangement for feeding the heddles to be drawn in (FIGS. 8–15C);

an arrangement for positioning the reed (See FIG. 18 and 19B);

an arrangement for drawing-in the heddles and for reeding (FIGS. 16–17C); and an arrangement for passing warp threads to the heddles which have been drawn in (FIGS. 21–23).

The arrangement for feeding the threads to be drawn-in obtains the thread 5 of at least one bobbin 46 and provides lengths from double folded thread 5'. The head of the length of the double folded thread 5' and then the tail is passed through two corresponding heddles 30 and between corresponding dents of reed 16. According to one embodiment, the two parts of each length of the thread having approximately equal extent and are provided in a manner such as to exhibit a substantially vertical section and a substantially horizontal section wherein the head and tail portions of each length form part of the horizontal section.

Figure 5A:
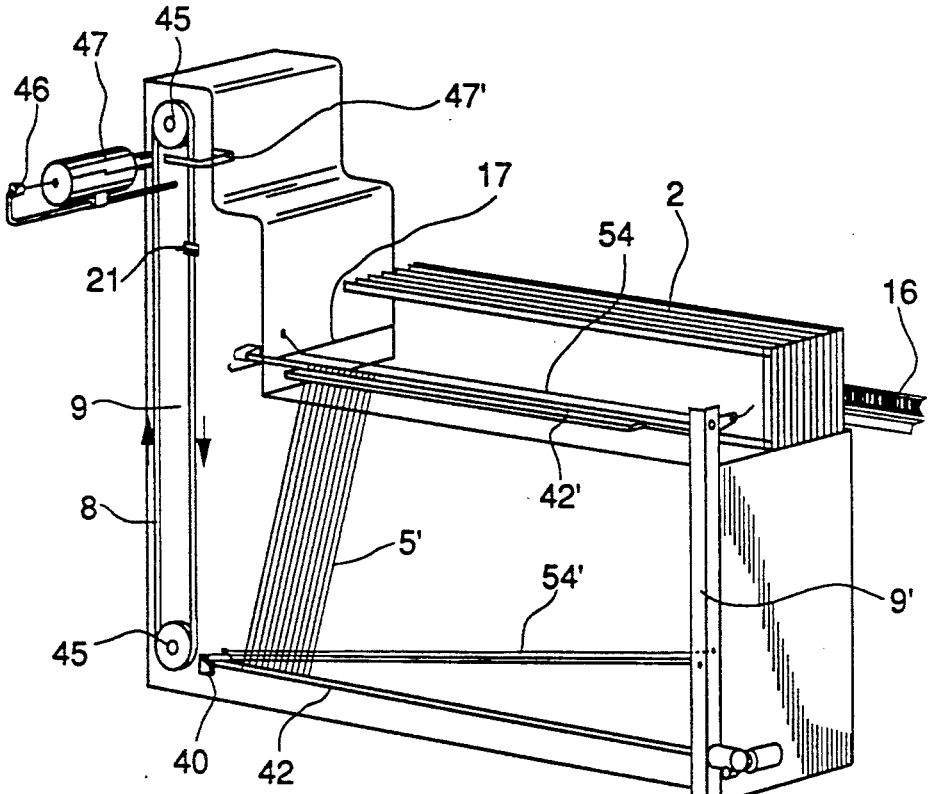
FIG. 5A is a perspective view showing a supply group for the lengths of thread according to the invention.
Figure 5B:
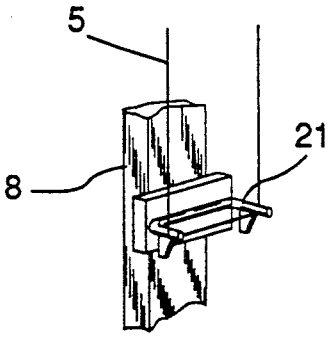
FIG. 5B is a detailed view of the thread-puller for the group in FIG. 5.
Figure 5C:
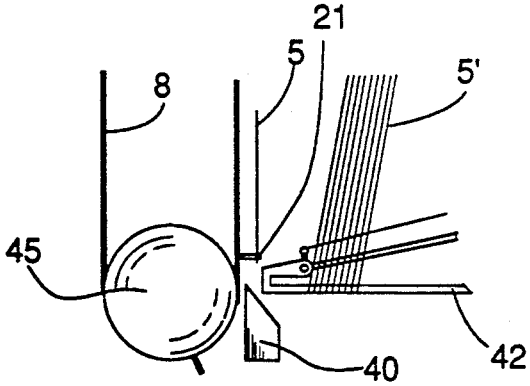
FIG. 5C is a detailed view of the derailer for the group in FIG. 5.

In order to feed the threads to be drawn in, the apparatus includes an upright support 9 supporting two end pulleys 45 (see FIGS. 1–4 and 5A–5C). One of the end pulleys 45 is an idle pulley and the other end pulley 45 is controlled by an electric motor (not shown). A preferably tooth belt 8 is stretched about the pulleys 45 and this belt 8 supports a thread puller 21 as shown in FIG. 5B. The thread puller 21 is preferably provided in the form of a fork and is structured to unwind the thread 5 provided by a magazine which, as stated above, is preferably in the form of a bobbin 46. The thread is fed from the bobbin 46 by means of a thread feeder 47 and a thread guide 47'. By means of the cooperation of a thread clamp 23 (see FIGS. 6A through 6L) a double length of thread 5' is obtained wherein each half of the double length 5' forms one thread to be drawn in.

Figure 6A:
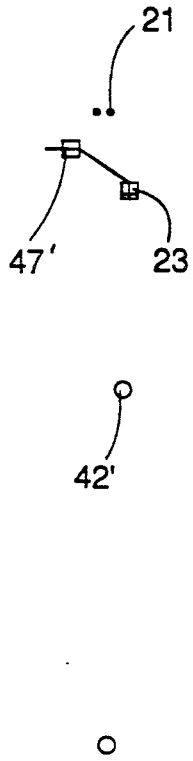
FIGS. 6A–6H are schematic views showing the phases of forming a double-headed length of thread, and passing the two threads according to the invention.
Figure 6B:
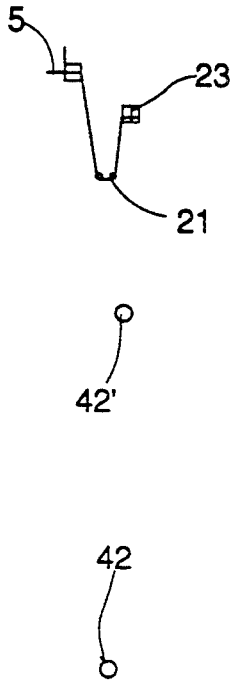
Figure 6C:
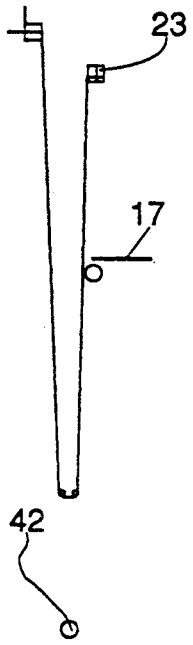
Figure 6D:
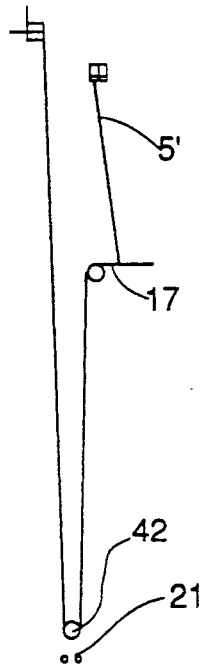
Figure 6E:
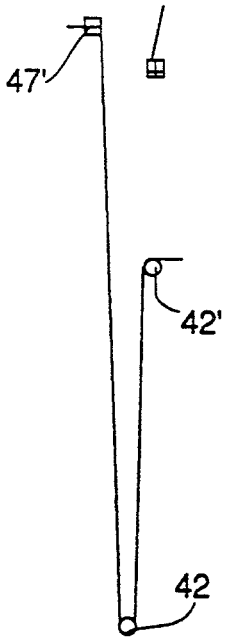
Figure 6F:
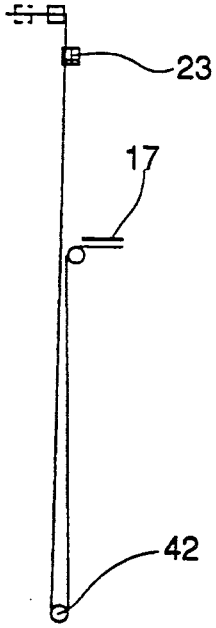
Figure 6G:
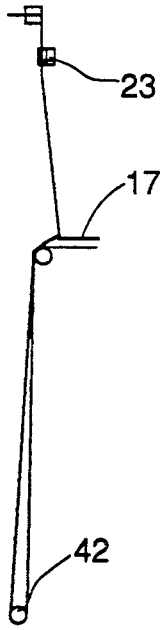
Figure 6H:
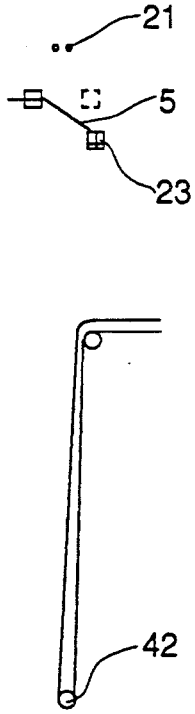
Figure 6I:
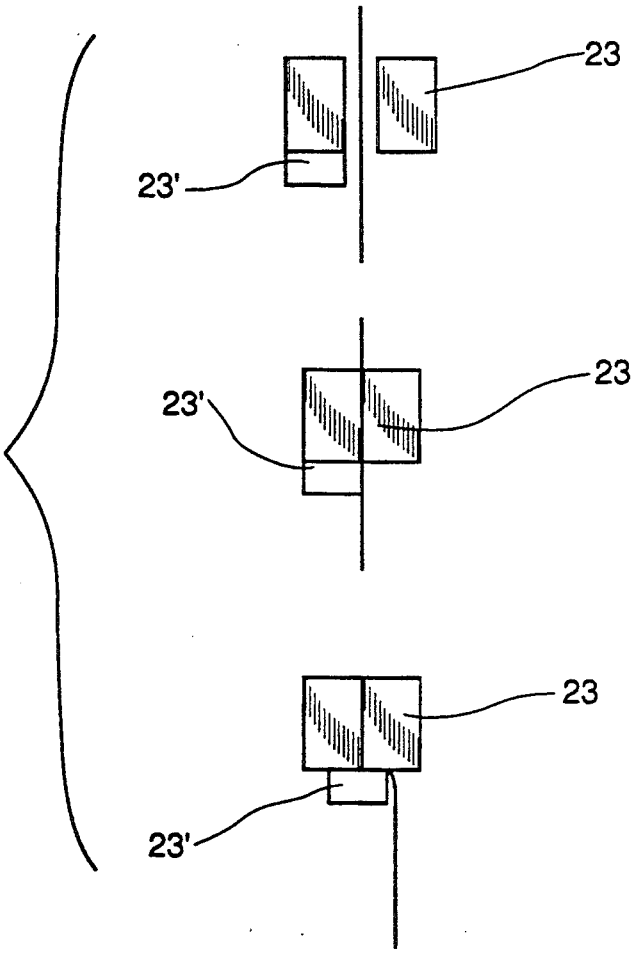
FIG. 6I is a schematic view showing details of the operation of the thread clamp with cutter for the group in FIG. 5.

As can be seen in FIGS. 6A through 6L, a thread clamp 23 with the associated cutter 23' first holds the head of the thread 5 during the formation of the double length 5' (see FIGS. 6A through 6C). As shown in FIG. 6A, the thread extends between the thread guide 47' for holding the thread on one side and the thread clamp 23 for holding the thread on another side. The thread puller 21 moves downwardly as shown in FIGS. 6B and 6C. As shown in FIG. 6D, the heddle hook 17 engages the thread pulling it over upper bar 42' and then the hook 17 engages the other side of the thread (see FIGS. 6F and 6G) to dispose both halves of the thread 5' at right angles with the center of the thread looped around lower bar 42 as shown in FIG. 6H. FIG. 6L shows the clamping action of the clamping element 23 including the cutting action of cutter 23'. The thread clamp 23 releases the thread 5 to permit the passage of a first half 5' of the length 5. Finally, the clamp 23 grips and retains the thread 5 and cuts the tail of the length in order to permit the passage of a second half 5'.

A pair of threaded horizontal and superposed bars 42, 42' (see FIGS. 5A, 5C and 7A, 7G) are used as thread support means for separately supporting two parts of the double lengths of thread, and these pair of threaded horizontal and superposed bars are provided rotating in unison about their own axis. These bars form the means for separately supporting the two parts of the double lengths of thread. The lower bar 42 protrudes with its free end in the vicinity of the lower pulley 45. A wedge-shaped derailer 40 is provided interposed between the pulley 45 and the free end of the lower bar 42 to permit the thread 5 to leave the thread puller 21 and to straddle the lower bar 42 forming a double head (see FIG. 6D). After this point, the needle hook 17, in its drawing-in travels comes to place the two halves 5' of the length of the thread 5 on the upper bar 42' forming an angle of 90° (see FIG. 6E). To facilitate this action, a thread presenter element 48 (see FIG. 7A) moves inwardly and outwardly as shown in FIGS. 7B through 7F. In this way, the thread presenter 48 moves each half 5' of the length 5 close to the hook element of heddle hook 17 and facilitates the gripping of each half 5'. As shown in FIGS. 7B through 7F, a rocker-type deflector 49 is provided for moving each drawn-in thread 5' away from the drawing-in head.

A brush 50 is provided having bristles which press on threads accommodated in the groove of the upper threaded bar 42'. In this way, the threads are tensioned. The brush 50 has an end sector 50' which can be lifted by the action of the deflector 49 to permit the passage of the threads 5'. A crank mechanism 51 is provided having an alternating semi-circular motion in order to lease the drawing-in threads 5' by means of a first cord 54. The first cord 54 is positioned respectively under the first thread and above the second thread of each length. A second cord 54' is fixed in a position above the lower bar 42 (see FIG. 1).

Figure 7A:
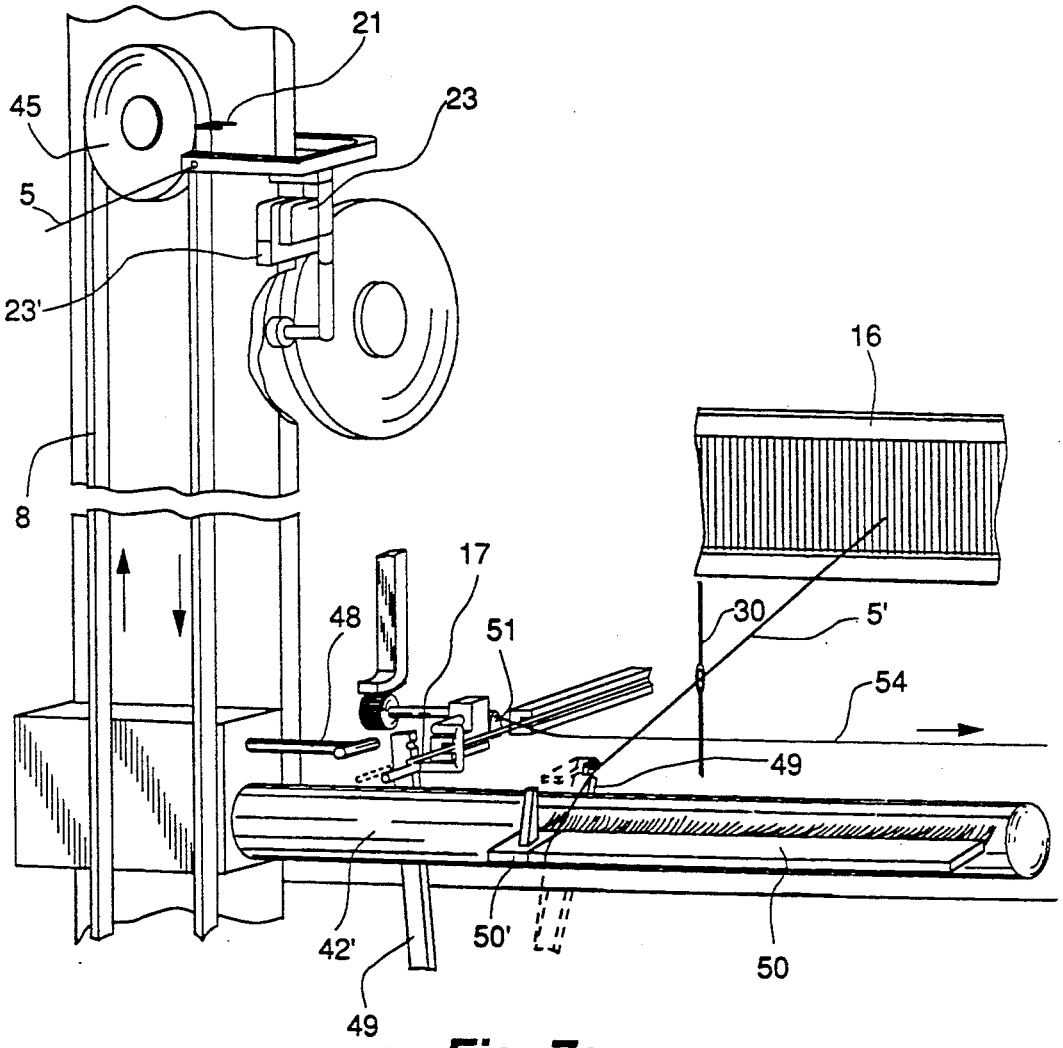
FIG. 7A is a schematic detail view of the thread clamp and the leaser for the group in FIG. 5.
Figure 7B:
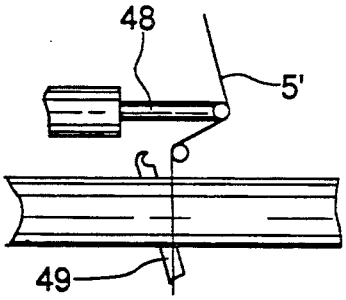
FIG. 7B–F is a schematic view showing the functioning of the thread presenter and the deflector for the group in FIG. 5.
Figure 7C:
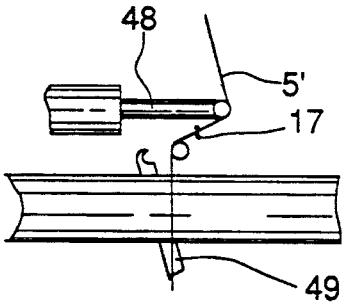
Figure 7D:
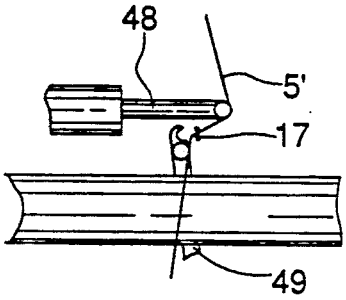
Figure 7E:
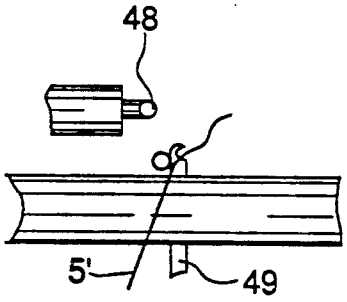
Figure 7F:
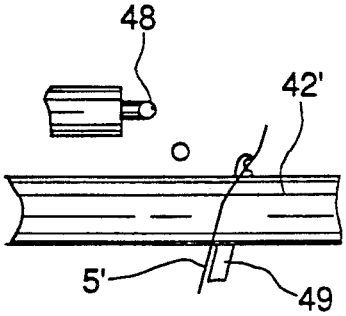
Figure 7G:
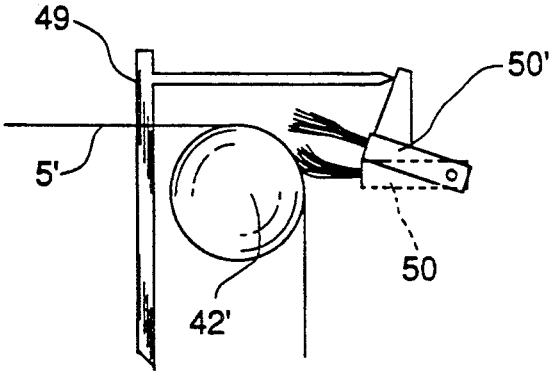
FIG. 7G is a schematic view showing the detail of the tensor for the group in FIG. 5.

As shown in FIG. 7A, the first cord 54 may be fixed at one end to the crank mechanism 51. The first cord. The first cord 54 may be fixed at the other end, to an upright 9' (see FIG. 55) which supports the lower thread bar 42 and the upper thread bar 42' such that the latter is unmovable longitudinally. Alternatively and preferably, the cord 54 is movable longitudinally, that is to say is driven in the direction away from the drawing-in head; in this case, the latter will be fed by means of a vertically oscillating magazine which takes the place of the crank mechanism 51. In this manner, wear between the drawn-in threads and the cord 54 is eliminated.

As an alternative to the lower threaded bar 42, it is possible, in accordance with the invention, to employ a continuous belt in the form of a horizontally developed ring, whose movement is such that its lower strand, a stride which the lengths of thread are positioned, moves from left to right in the arrangement shown in FIG. 5.

Figure 8:
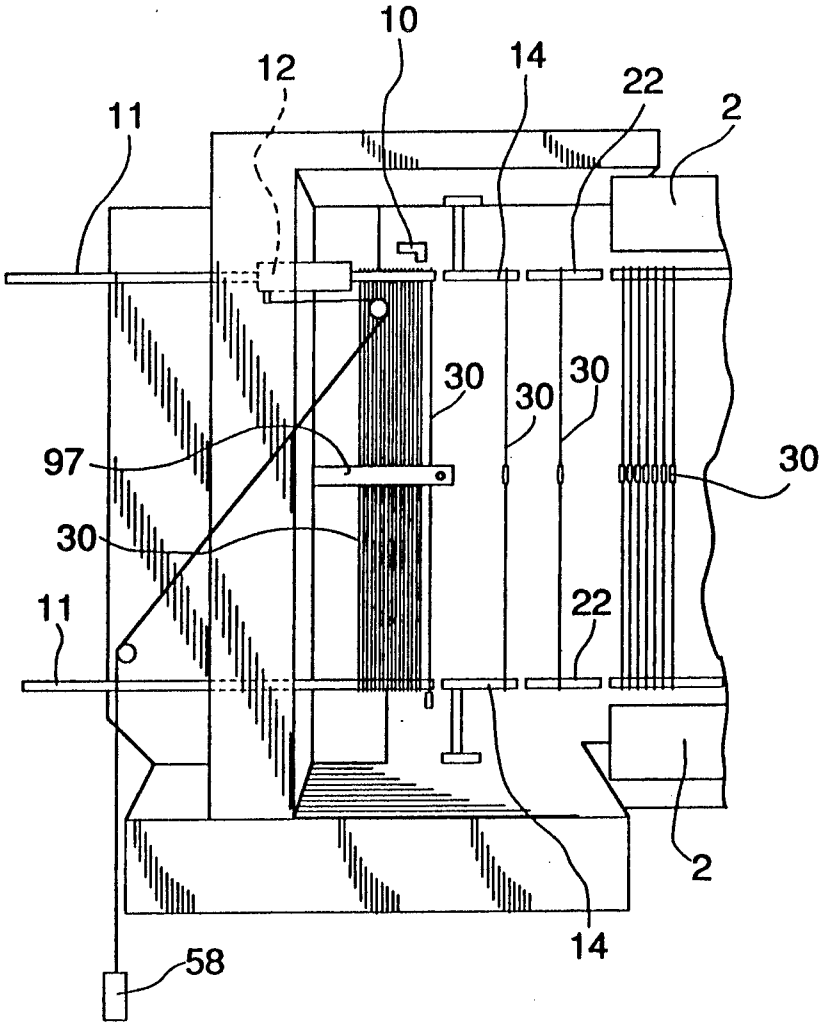
FIG. 8 is a schematic view showing the detail of a magazine of heddles according to the invention.
Figure 9:
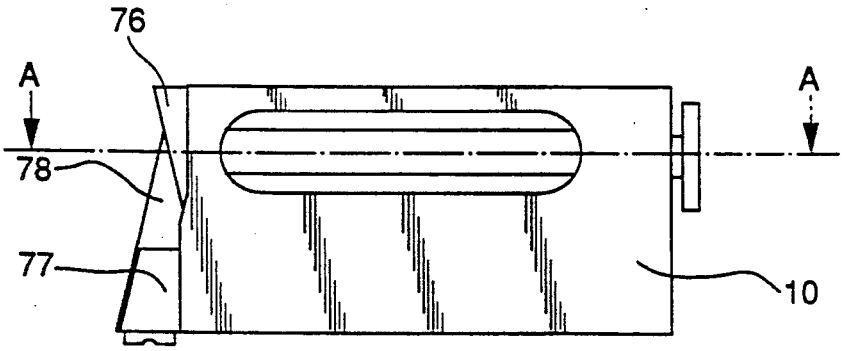
FIG. 9 is a schematic view showing the detail of a heddle selector according to the invention.
Figure 11:
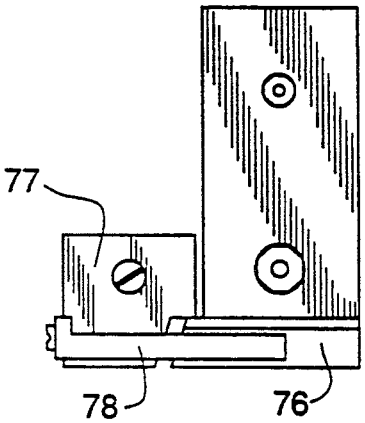
FIG. 11 is a schematic view showing the lateral view of the selector in FIG. 9.
Figure 10:
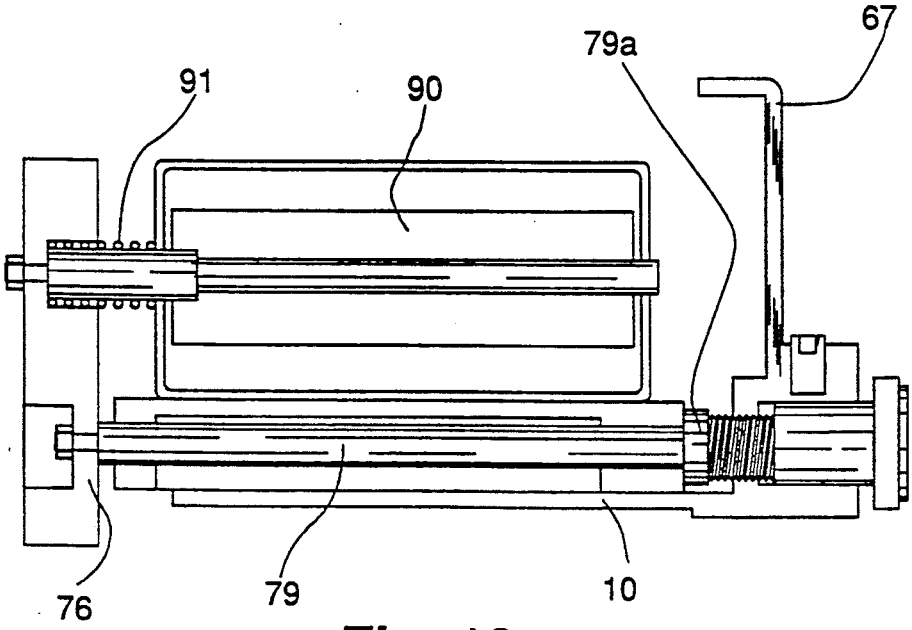
FIG. 10 is a schematic sectional view taken through A—A in FIG. 9.
Figure 12A:
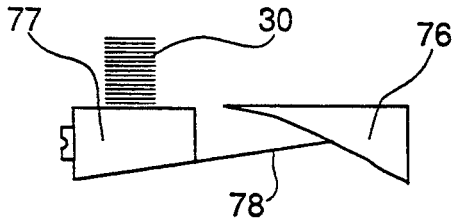
FIGS. 12A–12G are schematic views showing, successively, the phases of selecting a heddle by means of the selector in FIG. 9.
Figure 12E:
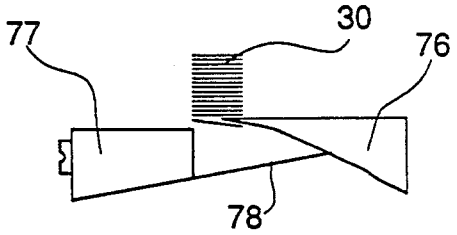
Figure 12B:
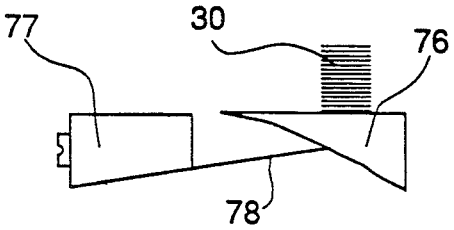
Figure 12F:
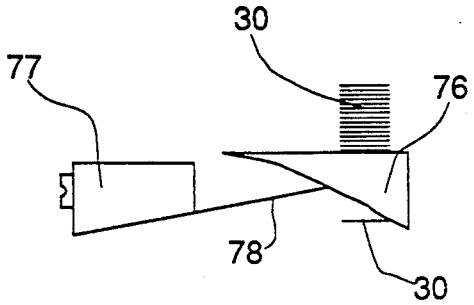
Figure 12C:
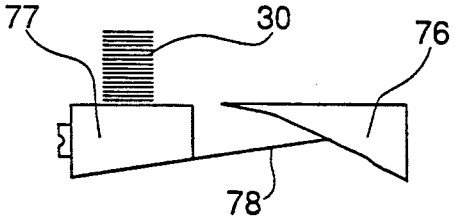
Figure 12G:
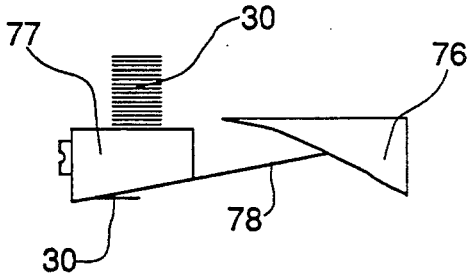
Figure 12D:
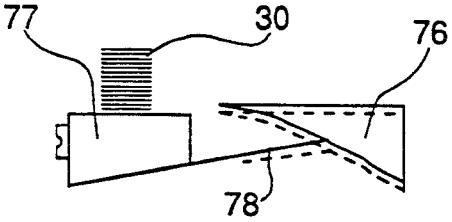

Referring to FIGS. 8 through 15C the feed arrangement for the heddles 30 is provided preferably comprising three separate magazines for accommodating the heddles 30. Each magazine supports a large number of heddles in a pendant attitude by means of a corresponding horizontal track 11 (see FIG. 11). As shown in FIG. 88, the upper and lower rails pass through the respective upper and lower loops 26, 27 of the heddles 30. The rails are packed side-by-side and pushed toward the drawing-in head by means of a corresponding pusher 12 (see FIGS. 1 and 8). The pusher 12 is provided with a counterweight 58 as seen in FIG. 8. A selector 10 is provided for each track 11 in alignment with the drawing-in head (see FIG. 8 and FIGS. 9 through 11). The selector 10 follows an alternating rectilinear movement in a direction transverse to the respective track 11. As shown in FIGS. 9 through 11, the selector 10 is provided with a stop block 77 for the pack of heddles, a plate 78 and with a wedge-shaped point 76 touching the plate 78.

As shown in FIGS. 12A through 12G, the block 77 is subjected to an electromagnet 90 (see FIG. 10) which upon activation causes a predetermined displacement away from the first heddle 30. The point 76 is also moved toward track 11 (see FIG. 12D) in order to permit, upon an advancing movement of the point 76 (see FIG. 12E) a selection of a heddle 30 (FIG. 12E) and a transference of the first heddle 30 in the pack downstream to the plate 78 (see FIGS. 12F and 12G).

Figure 14:
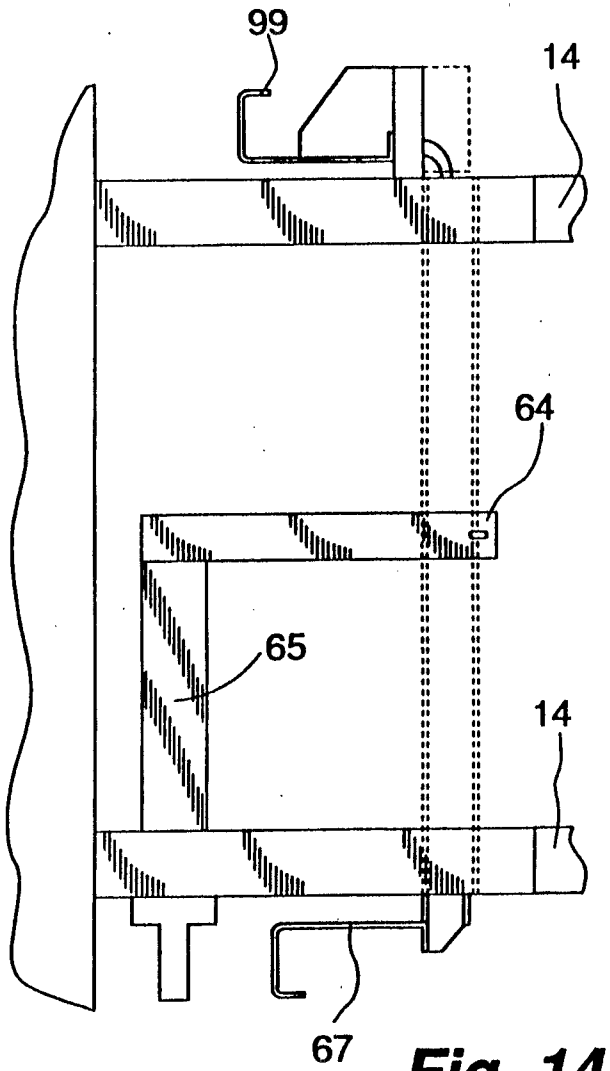
FIG. 14 is a schematic lateral view of the selector in FIG. 13.
Figure 13:
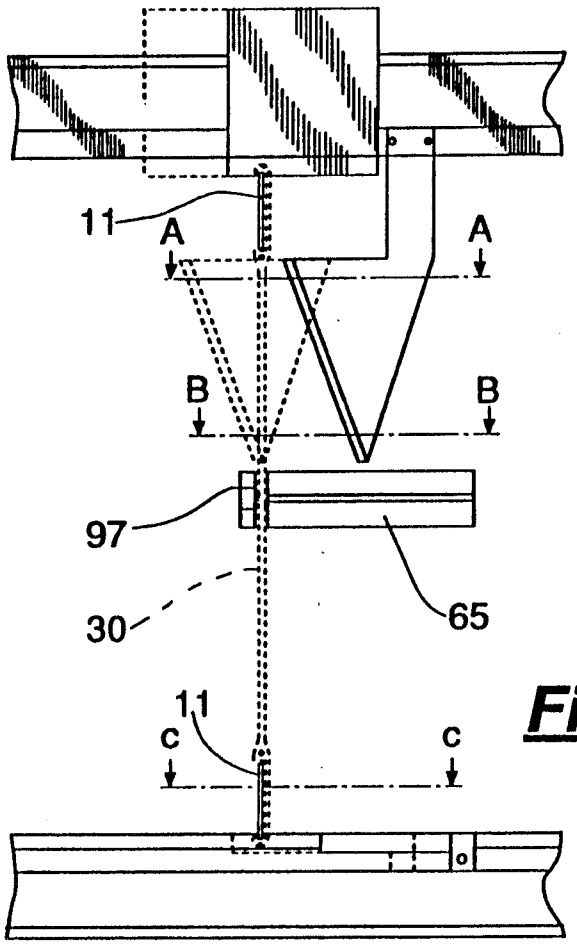
FIG. 13 is a front schematic elevation view of a wedge-shaped selector according to the invention.

As seen in FIGS. 13 and 14, a horizonal clip 65 is provided which is longitudinally perforated for the passage of the heddle hook 17. The horizontal clip 65 is movable transversely toward and away from the batten 97. The batten 97 is provided at the side of the pack of heddles 30 in each of the magazines (see FIG. 8). The aperture 97' of the batten 97 (see FIGS. 17A, 17B and 17C) is provided at the level of the eye 25 of the selected heddle 30 to permit the selected heddle to be oriented and retained, initially transversely to the longitudinal axis of the clip 65 and subsequently permitting the heddle hook 17, containing no thread (see FIG. 17B), to pass into the eye 25 and beyond the aperture 97' of the batten 97 and then to be retracted charged with thread 5 (see FIGS. 17B and 17C), thus achieving the drawing-in of the heddle 30 (see FIG. 17C).

As an alternative to the selector 10, it is possible to use a wedge-shaped spreader member, corresponding to the upper rail of the track 11. A flat member having a free end retracted relative to the point of the spreader may also be used corresponding to the lower rail of the track 11. This arrangement may be provided in the manner such that the advance of the flat member makes is possible to select and displace the first heddle 30 of the pack to a position in front of the clip 65 and the heddle hook 17.

Figure 15A:
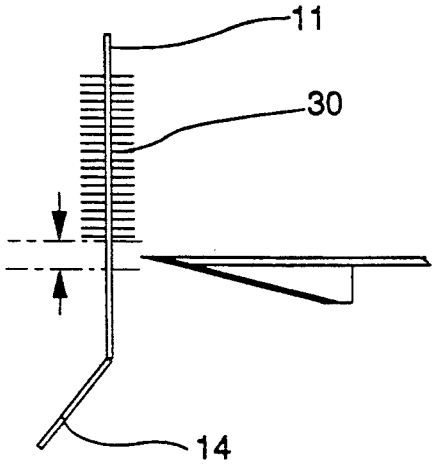
FIG. 15A is a schematic view showing the section through A—A in FIG. 13.
Figure 15B:
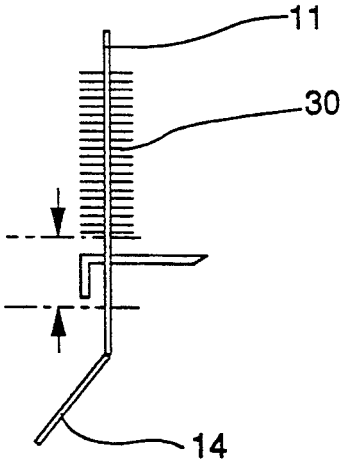
FIG. 15B is a schematic view showing the section through B—B in FIG. 13.
Figure 15C:
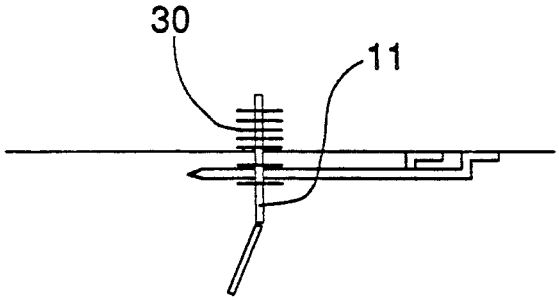
FIG. 15C is a schematic view showing the section through C—C in FIG. 13.
Figure 16:
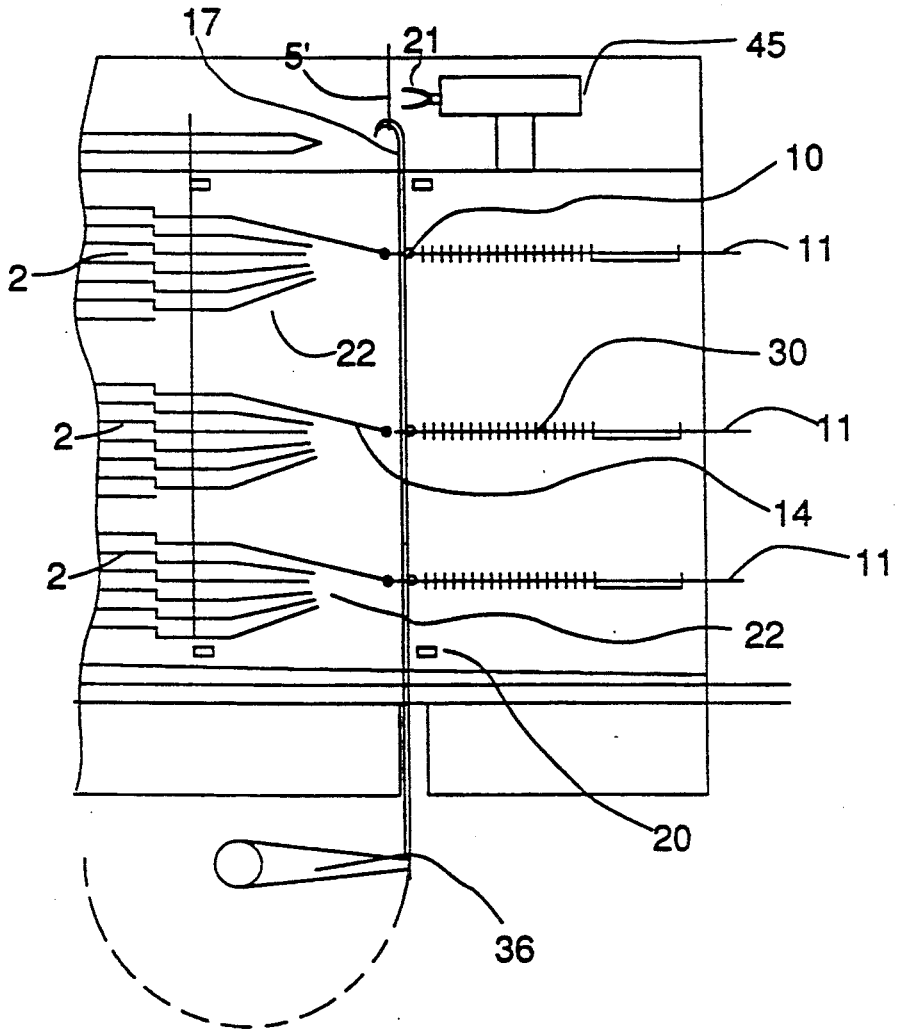
FIG. 16 is a schematic view showing the detail of the drawing-in zone according to the invention.
Figure 17A:
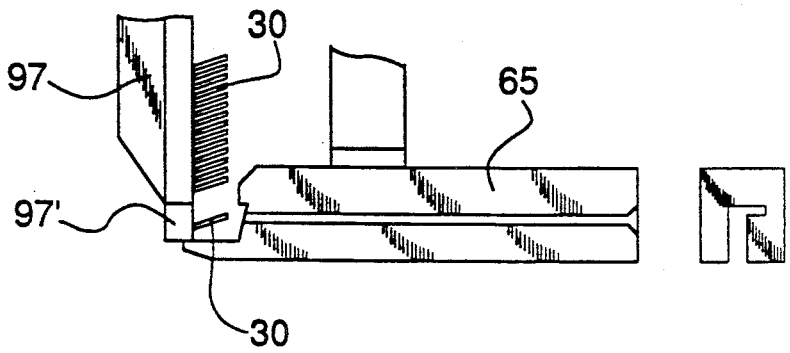
FIGS. 17A–17C are schematic views showing, successively, the phases of drawing in a heddle according to the invention.
Figure 17B:
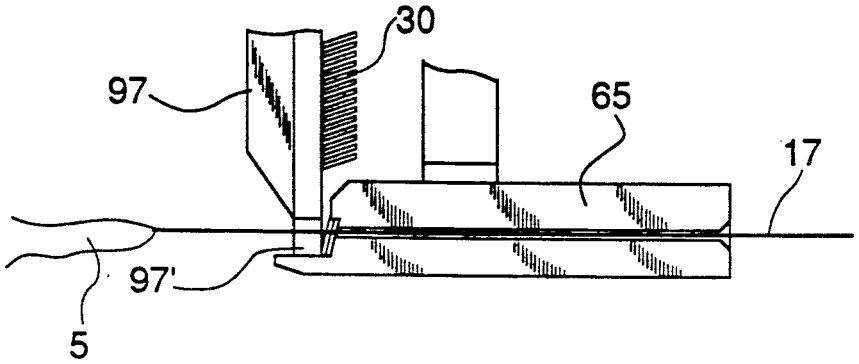
Figure 17C:
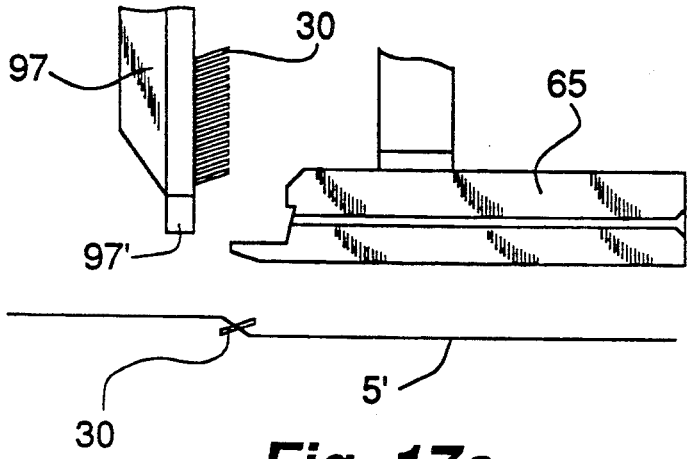

FIGS. 13 shows a front schematic view of the drawing-in of the selected heddle 30 with FIG. 14 showing a side view with FIG. 15A showing the sectional view through line A–A of FIG. 13, FIG. 15B showing the section view through line B–B of FIG. 13 and FIG. 15C showing the section view through C–C of FIG. 13. A top view of the drawing-in of the heddle 30 is shown in FIGS. 17A, 17B and 17C.

According to the invention, the reed 16 is positioned relative to the heddle hook 17 by an arrangement as shown in FIGS. 18 and 19A through 19E. As shown in FIG. 18, a reed 16 is mounted with the dents in the vertical attitude on a carriage 35. The carriage 35 is free to run on a horizontal track 56, parallel to the heddle frames 2. Intermittent advance of the reed 16 is provided by an electric motor 34 with the cooperation of a clutch 33. The clutch 33 and the electric motor cooperates such that when the electric motor 34 is inactive (non-activated) the clutch first releases the carriage 35 of the reed 16 during the spreading of the dents by the spreader 32 (see FIG. 19B). The clutch 33 then locks the carriage 35 during the passage of the thread (see FIGS. 19C) and the retraction of the spreader 32 (see FIG. 19D) and then when the electric motor 34 is activated, the clutch 32 permits the advance of the carriage 35 at a rate equal to that of the dents of the reed 1616 (see FIG. 19E).

Figure 20A:
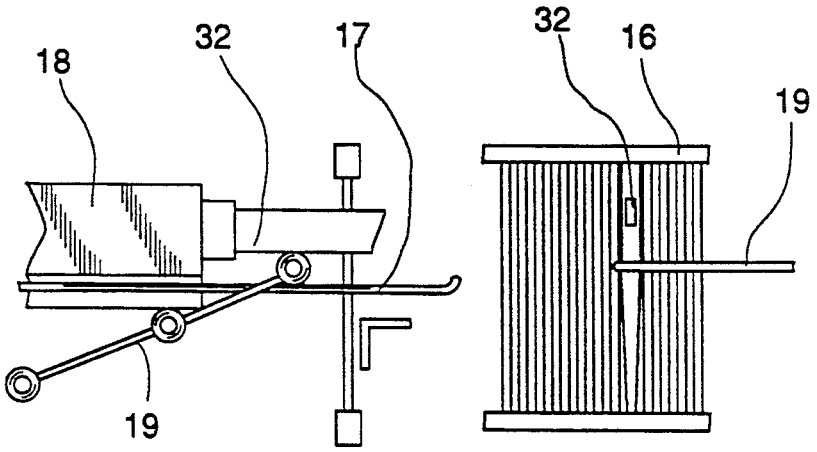
FIG. 20A and 20B are schematic views showing the detail of the heddle hook stripper after the drawing-in of a heddle according to the invention.
Figure 20B:
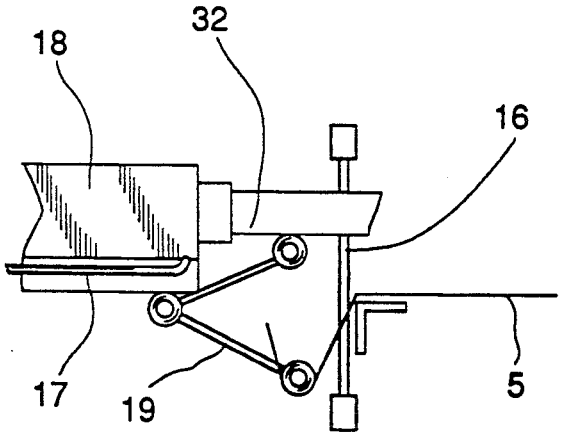

The arrangement for drawing-in of the heddles 30 and for the reeding is described in FIGS. 16, 17A through 17C, FIGS. 19A and 20. As shown in FIG. 19A, the heddle hook 17 is provided with an alternating horizontal rectilinear movement in the direction transverse to the above mentioned track 11. This movement is derived from the alternating rotation of a crank 36 by means of the plate 38 which is slidable in a corresponding cylindrical guide which is concentric to the crank 36. As seen in FIG. 20, the spreader 32, provided for the dents of the reed 16 which are to be passed (as described above), is provided with an alternating horizontal movement. The movement of the spreader member 32 is parallel and above the longitudinal axis of the heddle hook 17. The movement of the spreader 32 is due to the electromagnet 18. As seen in FIG. 20A and 20B, a thread cutting member 19 is provided in the form of a simple crank having a protruding arm which is oriented perpendicularly to the heddle hook 17. This thread-cutting member 19 strips the heddle hook 17 of the thread 5' after passage of the thread through the spread dents of the reed.

FIGS. 21, 22, and 23 show the arrangement for passing the warp threads, according to the invention. Three multiple deflectors 22 are provided each on an extension of one of the tracks 11. The deflector 22 heeds the heddles 30 and comprises 6 rails arranged in a manner of a fan connected downstream to the corresponding heddle frames 2 of the set of six heddle frames (see FIG. 21). A needle 14 (see FIG. 22) is provided having a heel hinged to a corresponding rail of the track 11 of the heddles 30. The needle 14 is subject to the action of rocker 74 (see FIG. 22) which oscillates about the axis of the heel under the control of an electric motor 98. The electric motor 98 is preferably a stepping motor. The motor 98 cooperates with the return shaft 96 and the pulleys 94 and the belts 95 in order to connect the associated track 11 of the heddles 30 separately which each of the six heddle frames two of a set of heddle frames (see FIG. 21). As seen in FIG. 21, three pushers 73, (only one shown in FIG. 21) each associated with a deflector 22, are provided in order to cause the advance of each heddle 30 which has already been drawn in. Pushers 73 act on the lower and upper ends of the heddle 30, under the control of two corresponding articulated links 68–72. These linkages are respectively actuated by a lower plate 67 and upper plate 99 and undergo a rectilinear, alternating, non-synchronous motion.

OPERATION

Figure 25:
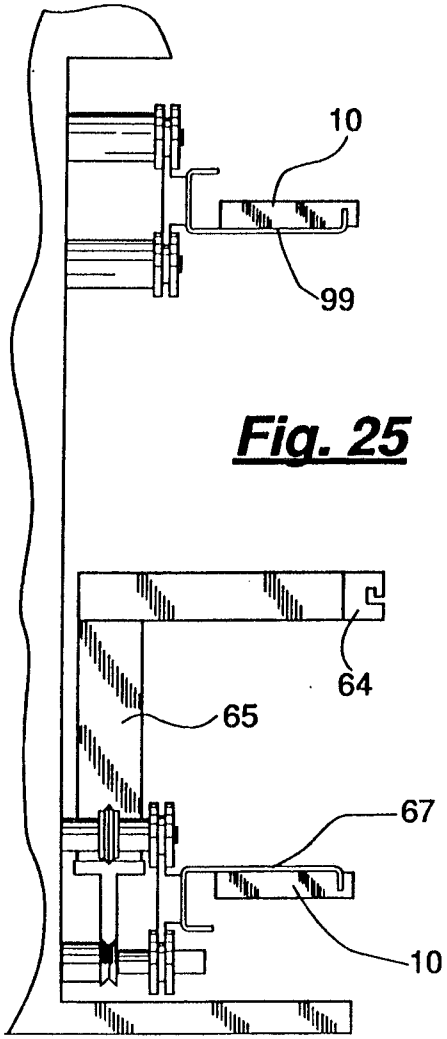
FIG. 25 is a schematic lateral view of the means in FIG. 24.
Figure 24:
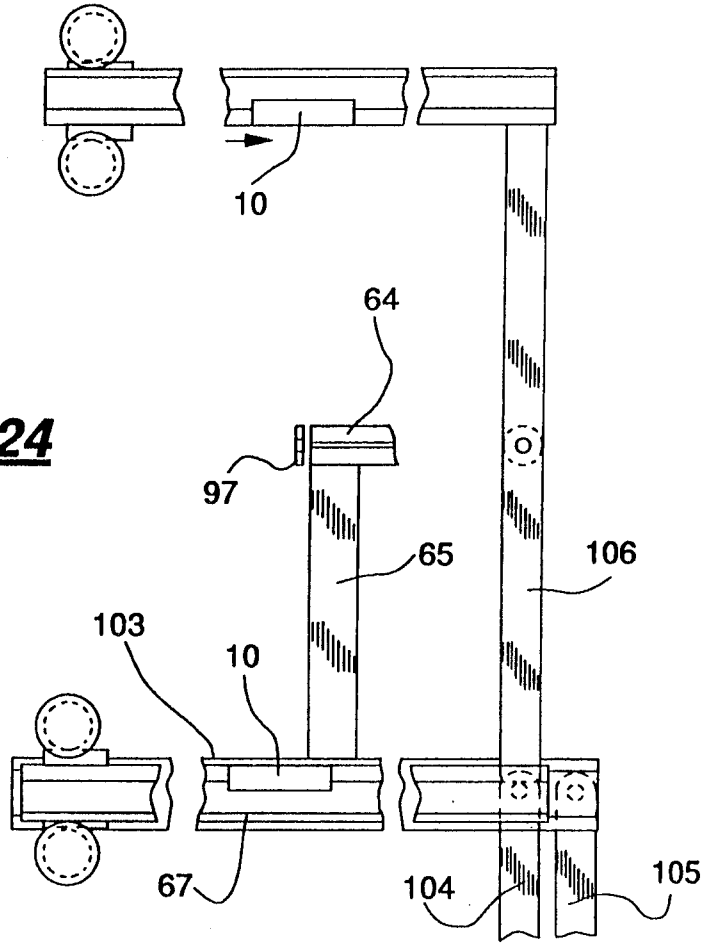
FIG. 24 is a side schematic view showing the detail of the transporting means for the heddles according to the invention.

In operation, the active selector 10 takes a heedle 30 from one of the tracks 11 (see FIGS. 8 and 12A through 12G) and the clip 65 (FIG. 13) positions the heddle with the eye 25 opposite the aperture 97' of the corresponding batten 97. At the same time, the reed 16 is positioned with the dents to be passed opposite the free end of the heddle hook 17 and with the spreader member 32 inserted between the dents (see FIGS. 19A and 19B). Next, the heddle hook 17, in the course of its travel, is introduced between the dents of the reed that have just been spread and thereafter, the heddle hook 17 is introduced in the aperture of the batten 97 (see FIGS. 17A through 17C). Finally, the heddle hook 17 is introduced into the eye 25 of the heddle 30 until it reaches and grips the thread 5' (see FIG. 17B). The thread 5' is provided in a position for being received by the heddle hook 17 by means of the thread presenter 48 (see FIG. 7A). During its return travel, the heddle hook 17 performs the drawing-in of the heddle and the reeding, after which the heddle hook 17 is stripped of the thread by the action of the thread cutter 19 (see FIGS. 20A and 20B). At this point, the needle 14 of the deflector 22, corresponding to the selector 10 which grip the heddle 30, initiates the sending of the heddle 30 to the heddle frame 2 of the corresponding set of heddle frames. The corresponding set of heddle frames is predetermined by the passing of the warp thread and the pusher 73, which is associated with the deflector 22,1 which causes the heddle to advance (see FIG. 21). The movement of the plate 67 and 99 associated with the pusher 73 and the movement of the clip 65 of the thread cutter 19 and the movement of the heddle hook 17 is provided by an adjustable speed motor 120 with the interposition of a belt 121, cams 111, 114, 116 and the rockers 104–106 as shown in FIGS. 23 through 25.

It goes without saying that the person skilled in the art will be well aware that, in place of the cams, it is possible to employ electric motors of the stepping type, suitably programmed, and that the control for the positioning and spreading of the dents of the reed, suitably programmed, also enables a plurality of threads to be passed between the dents of the reed.

At the final drawing-in, the drawing-in threads are locked by two clip-type wooden fish plates, and then the threads are cut at their double head and the support with the leased, drawn-in and reeded threads is transferred to the loom, where the threads are knotted to the threads of the warp beam and the wires of the warp stop are set.

In practice, the details of embodiment may vary in an equivalent manner in respect of shape, dimensions, arrangement of the elements, or type of materials employed, without thereby departing from the scope of the solution concept adopted, and thus remaining within the limits of the protection specified in the appended claims.

I claim:

1. A method of automatic drawing-in comprising the steps of:

forming lengths of double folded thread obtained from a thread magazine;

storing heddles in a plurality of packs;

selecting a singular heddle from the plurality of packs to be drawn-in;

passing first a head of each length of double folded thread and then a tail of each length of double folded thread into said selected heddle;

positioning a reed with a first forward movement at a constant rate to obtain a precise alignment between a vertical axis of a space contained between two dents of the reed and a vertical axis of cross section of a heddle hook;

passing the head and then the tail of each length of double folded thread between the selected dents of the reed;

leasing and tensioning the heddled and reeded threads;

progressively moving the reeded and leased threads away from the drawing-in location passing said drawn-in heddle directly from a track of an associated pack of heddles to a track of a corresponding set of heddle frames while maintaining another heddle retained in a guide.

2. A method according to claim 1, wherein said forming of said lengths of double folded thread in a manner to include two parts having a approximately equal length, each part having one section disposed substantially vertically and another section disposed substantially horizontally.

3. A method according to claim 1, wherein said step of leasing the threads includes stretching a cord within a double head formed by each length of thread and moving the cord with an alternating vertical motion, relative to a drawing-in plane and stretching a second cord perpendicular to the threads and inverting the motion after passage of each thread.

4. A method according to claim 3, wherein:

said second cord is held stationary in a longitudinal direction with respect to the drawing-in location.

5. A method according to claim 3, wherein said second cord is moved in a longitudinal direction with respect to the drawing-in location.

6. A machine for automatic leasing, comprising:

a feeding arrangement for feeding drawing-in threads including supply means for supplying first a head and then a tail of doubled lengths of thread to a heddle hook;

a magazine of thread providing thread to said supply means;

an arrangement for feeding in drawing-in threads including a thread puller and a thread clamp having a cutting element, said clamp and cutting element for engaging and cutting pulled thread; thread support means for separately supporting two parts of the doubled lengths of thread and for moving the doubled lengths of thread progressively away from a drawing-in region;

a heddle feeding arrangement including a plurality of heddle magazines having a plurality of adjacent tracks for the passage of pendant heddles, each track extending a length of a corresponding set of a plurality of heddle frames and a multiple deflector with a needle for connecting an associated track of heddles with each of said plurality of heddle frames; and reed positioning means including a carriage carrying a reed, said reed having vertical dents, said carriage being movable on a horizontal track parallel to said heddle frames, a spreader for opening the dents and an electric motor having a clutch for intermittent advancing of said reed.

7. A machine according to claim 6, wherein said thread support means comprises first and second horizontal thread bars positioned at different heights for rotation in unison and a derailer for directing lengths of thread being formed from said thread puller to a lower one of said first and second horizonal threaded bars;

8. A machine according to claim 7, wherein said thread puller is fixed to a continuous ring-type belt, said belt being positioned extending vertically for moving said thread puller to intercept thread extending between said thread magazine and said thread clamp in a region wherein said thread puller starts downward travel, said derailer including a wedge having a vertex at a top portion and having an inclined flank facing and extending below a free end of the lower one of said first and second horizontal thread bars, said wedge being positioned to intercept said thread puller in a region corresponding to the end of said downward travel.

9. A machine according to claim 7, wherein said lower one of said first and second horizontal thread bars includes a free end protruding to a location spaced from said toothed belt at a lower region of said toothed belt.

10. A machine according to claim 8, wherein said lower one of said first and second horizontal thread bars includes a free end protruding to a location spaced from said toothed belt at a lower region of said toothed belt.

11. A machine according to claim 9, wherein a leasing cord is fixed and tensioned above said lowermost of said first and second horizontal thread bars wherein said leasing cord is positioned between lengths of said doubled lengths of thread.

12. A machine according to claim 6, wherein said means for separately supporting two parts of said doubled lengths of thread comprises a ring-type continuous belt extending horizontally, movement of said ring-type continuous belt providing movement of the lengths of thread away from said derailer.

13. A machine according to claim 6, wherein said arrangement for feeding in drawing-in threads further comprises an alternating element for moving a length of thread for engagement by the heddle hook in a horizontal plane above the heddle hook for positioning and intercepting an active end of a length of thread in an active travel path, a first part of the length of thread in a region between said thread puller and said thread clamp and to intercept a second part of the length of thread in a region between said thread clamp and a lower bar forming a part of said thread support means for separately supporting two parts of said lengths of thread.

14. A machine according to claim 6, wherein said arrangement for drawing in threads further comprises means for leasing the threads including a crank mechanism having an alternating motion about a horizontal axis, said crank mechanism including a protruding arm connected to one end of a cord, said cord having another end fixed to an upright supporting said means supporting said two parts of said lengths of thread separately.

15. A machine according to claim 6, wherein said arrangement for feeding the drawing-in threads further comprises a rocker-type deflector for moving each thread away from a drawing-in location after drawing-in.

16. A machine according to claim 13, wherein said arrangement for feeding the drawing-in threads further comprises means for tensioning the leasing threads including a brush tensor having bristles acting tangentially to an upper one of said threaded bars, a portion of said brush being liftable under the action of said rocker-type deflector.

17. A machine according to claim 6, wherein each one of the needles of the multiple deflectors is hinged to an associated rail of a corresponding said track of said magazines of heddles, each needle oscillating via a transmission arrangement connected to a stepper motor, said transmission arrangement including a belt, pulley and a rocker element.

* * * * *